US005357906A

United States Patent [19]

Brazier

[11] Patent Number: 5,357,906

[45] Date of Patent: Oct. 25, 1994

[54] SUBMERSIBLE LIQUID-TO-LIQUID HEAT EXCHANGER

[76] Inventor: Dennis Brazier, Rte. 1, Box 220, Greenbush, Minn. 56726

[21] Appl. No.: 116,850

[22] Filed: Sep. 7, 1993

[51] Int. Cl.[5] ..... F22B 1/02

[52] U.S. Cl. ..... 122/32; 122/13.1; 165/154; 165/155

[58] Field of Search ..... 122/32, 33, 13.1; 165/154, 155

[56] References Cited

U.S. PATENT DOCUMENTS 3,401,082 9/1968 Ammon et al. ..... 122/32 X
3,534,812 10/1970 Sandri ..... 122/32 X
3,776,302 12/1973 Waszink et al. ..... 122/32 X

*Primary Examiner*—Edward G. Favors
*Attorney, Agent, or Firm*—D. L. Tschida

[57] ABSTRACT

A single port, internal liquid heat exchange assembly for heating domestic water from a free-standing, low pressure wood fired boiler. A threaded manifold fastener retains the assembly in suspension within a single access port of a conventional water heater. An elongated manifold contains first and second coaxial flow columns which terminate at exposed inlet and outlet ports and communicate with each other within the manifold. Constructions are disclosed having concentric flow columns, convolute and expandable manifold walls, internal bypass ports, vibration dampeners, multiported flow transition zones and which may include a sacrificial anode.

18 Claims, 7 Drawing Sheets

SUBMERSIBLE LIQUID-TO-LIQUID HEAT EXCHANGER

BACKGROUND OF THE INVENTION

The present invention relates to liquid heat exchangers and, in particular, to an internally mounted, probe-type exchanger, which mounts to a single access port of a storage tank, such as a conventional, domestic water heater, and through which a low pressure heated liquid is distributed from a boiler.

Renewable fuel heating systems have become increasingly more popular as fossil fuel costs have risen over the years. Wood fired boilers such as manufactured by the present assignee, Central Boiler, Inc. of Greenbush, Minn. have found particular consumer acceptance. These boilers provide a free-standing housing, which encases an insulated liquid heat exchanger, and which surrounds a wood fueled firebox. Heated liquid is conducted at low pressures underground from the boiler through plastic conduits to interior conduits at the heated premises. Liquid-to-air heat exchangers are provided about the residential or industrial premises to transfer the heat to the interior space.

For many systems, the heated liquid may also be conducted to a separate, liquid-to-liquid heat exchanger at a water heater provided at the premises. Many such exchangers provide an externally mounted assembly which couples to top and bottom ports of a provided hot water heater to obtain a closed loop, thermo-siphon flow at the water heater.

Although thermo-siphon assemblies have been used for many years, they present a variety of deficiencies. While conceptually relatively simple, such assemblies frequently require professional installation. Proper alignment must also be maintained to prevent airlock. Alternatively, periodic purges must be performed, either manually or via an automatic purge valve. Scale within the boiler supply loop can also collect at flow transition regions within the system to restrict flow and reduce efficiency. Most significantly, the external mounting of such assemblies frequently requires that the exchanger be separately insulated to reduce radiant heat to the living space from the exchanger, which can create uncomfortable ambient temperatures during warm weather conditions.

Other, multi-ported, internal assemblies are also known. One, in particular, provides a specially constructed liquid storage container which includes an integrated, serpentine flow column. Separate inlet and outlet ports at the tank walls direct the heated liquid to the ends of the heat exchanger.

In appreciation of the foregoing deficiencies, the present invention provides an internally mounted liquid-to-liquid heat exchanger which can be secured without modification to the sacrificial anode port or bunghole provided with conventional domestic water heaters. A threaded manifold fastener seals the exchanger assembly within the tank cavity. Exposed inlet and outlet ports direct supply and return flow to the boiler. Installation can be performed by non-professional installers in a matter of minutes. Radiant heat transferred to the ambient environment is also substantially reduced.

SUMMARY OF THE INVENTION

It is accordingly a primary object of the present invention to provide a submersible liquid heat exchanger which mounts to a single port of a liquid storage tank.

It is a further object of the invention to construct the exchanger to mount to a three-quarter inch threaded port, such as the sacrificial anode port or bunghole of a conventional water heater.

It is a further object of the invention to provide an assembly including a manifold housing having co-axial, concentric flow columns, which columns communicate with exposed inlet and return flow ports, and which columns are spaced apart from one another in a manner which prevents vibration, such as with vibration dampeners.

It is a further object of the invention to provide one or more controlled bypass and transition ports between the flow columns to control flow rate and heat transfer to the domestic water heater.

It is a further object of the invention to provide a manifold housing having convoluted or expandable external walls to maximize the heat transfer surface.

Various of the foregoing objects, advantages and distinctions of the invention are particularly obtained in a presently preferred, probe-type construction which provides an elongated, submersible manifold housing having a concentric, threaded fastener or seal which mates to the sacrificial anode port of a water heater. Exposed inlet and outlet flow ports project from the assembly above the seal to mate with concentric internal flow columns which extend the length of the housing. The internal column may be bent slightly to firmly contact the outer column walls or spacers separate the flow columns from each other to prevent vibration. Flow rates through the assembly can be controlled with one or more internal bypass ports. One or more flow transition regions between the columns may include multiple bores or slots to reduce hot spots and possible restrictions in the event of scale. The external manifold housing may also include convoluted or expandable walls to provide optimal heat transfer area.

Still other objects, advantages and distinctions of the invention will become more apparent from the following detailed description with respect to the appended drawings. To the extent various modifications and improvements have been considered they are described as appropriate. The description should not be literally interpreted in limitation of the scope of the invention, which rather should be interpreted within the scope of the appended claims.

DESCRIPTION OF THE PREFERRED EMBODIMENT

Figure 1:
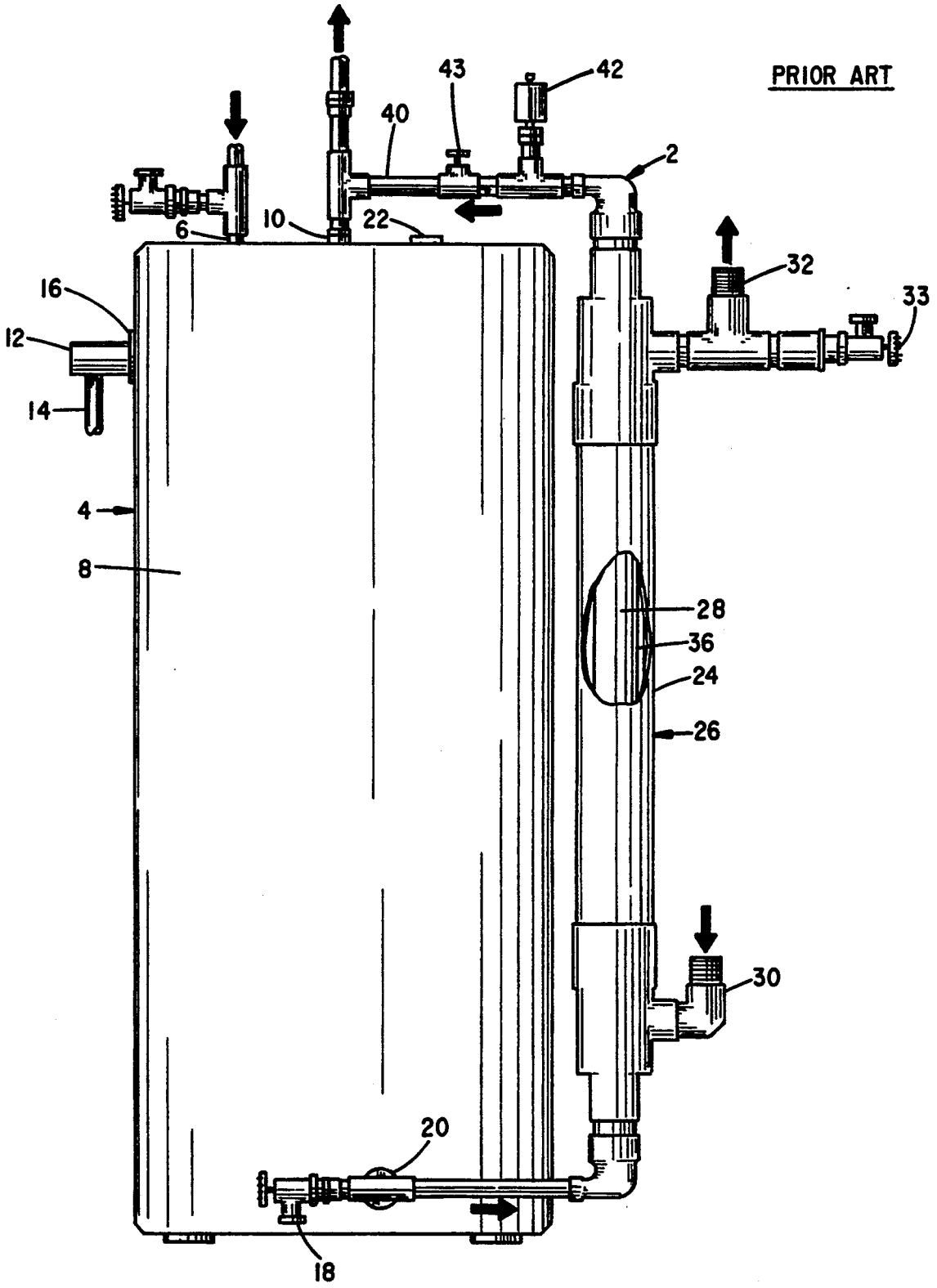
FIG. 1 is a drawing showing a prior art, externally mounted, thermo-siphon type, liquid-to-liquid heat exchange assembly.

Referring to FIG. 1, a diagram is shown of a prior art external, thermo-siphon type liquid-to-liquid heat exchanger 2. The assembly 2 is commonly used to heat domestic water within a small volume water heater 4 such as commonly found in residential and light industrial settings. The heat exchanger 2 has particularly been used in association with wood fired boiler systems sold by Central Boiler, Inc. of Greenbush, Minn.

The water heater 4 includes a sealed tank 8 which is sized to accommodate a storage capacity on the order of 30 to 100 gallons. An available water supply, such as an on-site well or community water supply, is coupled through suitable plumbing conduits to an inlet or supply port 6. The liquid is temporarily contained within the tank 8 and heated to a preferred temperature on the order of 100 to 130 degrees Fahrenheit for distribution, upon demand, to an outlet port 10 and plumbing fixtures distributed about the user premises.

A pressure relief valve 12 and vent conduit 14 extend from a threaded port 16 at the sidewall of the water heater 4 to vent the tank 8, should the interior pressure rise above a predetermined setting. A sillcock 18 projects from a threaded drain port 20 at the lower end of the tank 8. A separate electric or gas fired heating element (not shown) is mounted at the lower end of the tank 8, which operates in response to a thermostat control.

A sacrificial anode (not shown) is typically provided at a threaded port 22 at the top of the tank 8. A suitable bung anode is contained within the tank 8 in contact with the liquid to prevent electrolysis and consequent damage to the tank over time, due to the typical grounding of the building electrical system to the water supply conduits. The port 22 commonly provides a threaded ¾ inch bunghole.

The exchanger assembly 2 is configured to provide a thermo-siphon flow and heat transfer. That is, heated boiler water is conducted at low pressures through an external chamber or flow column 24 of a manifold housing 26. The housing 26 also contains an internal, smaller diameter chamber 28 (shown in dashed line) which is physically isolated from and co-extensive with the chamber 24. Heated boiler liquid is continuously circulated through the chamber 24 via supply and return ports 30 and 32. The ports 30 and 32 are coupled to a liquid boiler (not shown). A sillcock 33 is provided to facilitate system draining, purging etc.

As heated boiler liquid is circulated through the chamber 24, heat is absorbed by the domestic water in the chamber 28. As the heated water rises, cooler water is drawn from the tank 8. The heated water is directed through the outlet port 10 and back into the tank 8 or to the premise's plumbing conduits.

The internal chamber 28 is constructed of a one inch inside diameter tubular conduit 36. The chamber 24 is constructed of a 1 ½ to 2 inch housing 26, which concentrically surrounds the conduit 36. Appropriate plumbing fittings are secured to the upper and lower ends of the housing 26 to reduce the housing 26 down to a ¾ outside diameter fitting size to mate with the ¾ inch fittings typically provided at the outlet port 10 and drain port 20.

Although thermo-siphoning is conceptually, relatively straightforward, in practice difficulties often arise with potential blockage of the conduit paths, should scale within the boiler system or water heater become trapped at the necessary elbows and reducer fittings of the exchanger 2. Depending upon the quality of the domestic water, air-lock conditions can occur at the upper horizontal flow path 40. An automatic purge valve 42 is shown which alleviates this condition. To further prevent over-heating, a conventional tempering valve 43 and cold water supply may be coupled to the hot water supply conduits near the outlet port 10 to assure a water temperature within a preferred temperature range.

Figure 2:
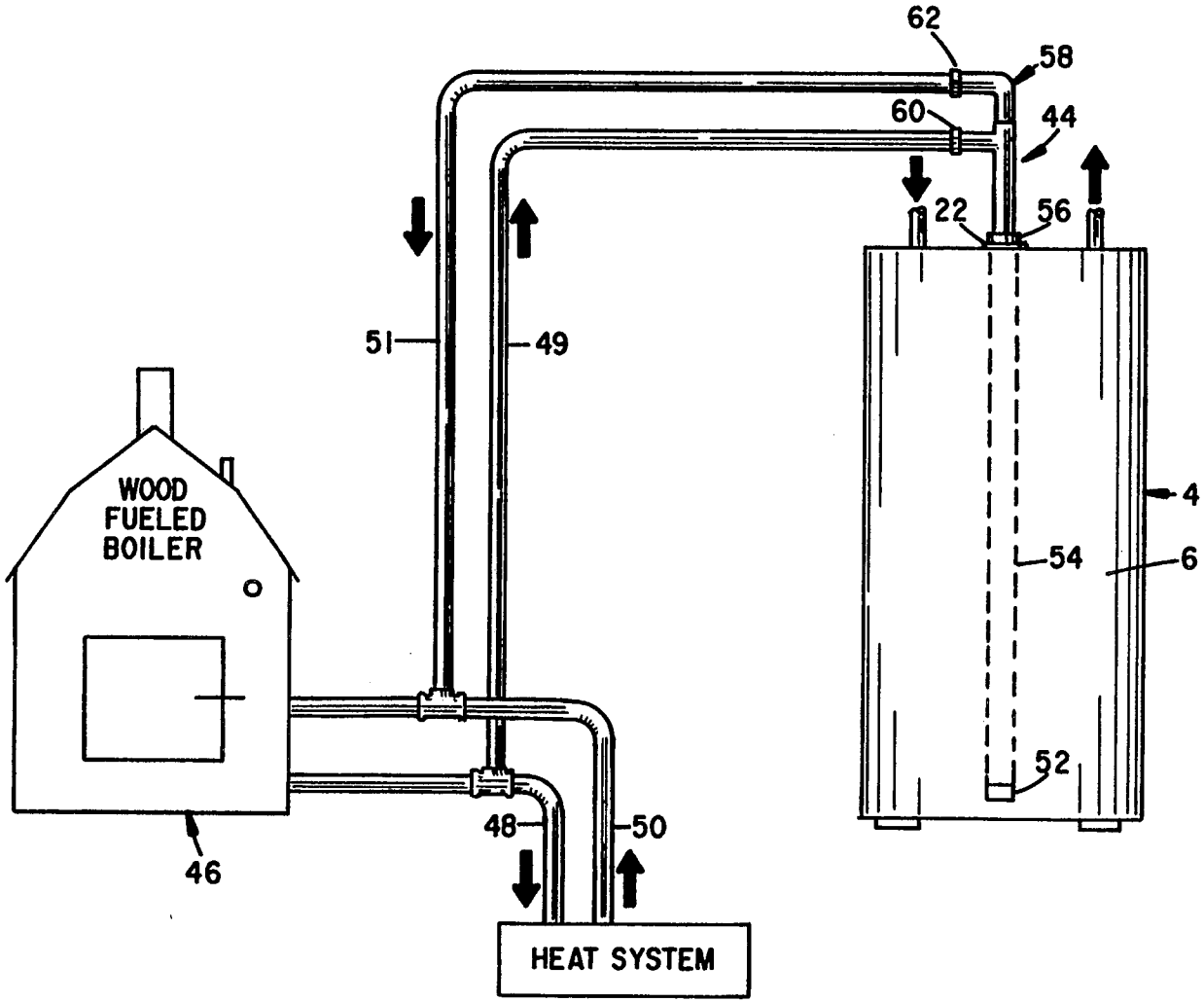
FIG. 2 is a system diagram showing the single port mounted, submersible heat exchanger of the invention.

The foregoing shortcomings of the prior art assembly 26, taken with the further necessity of requiring a professional plumber to install the exchanger assembly 26, led to the development of the probe-type, submersible assembly 44 of FIG. 2. The exchanger 44 finds particular advantage in residential and light industrial settings, especially where a free-standing, wood-fueled boiler 46 services the heating requirements of the premises. A variety of such boilers are available from Central Boiler, Inc. of Greenbush, Minn.

The boiler 46 includes a firebox which is surrounded by a liquid containing heat exchanger. The size of the firebox and exchanger can be adjusted to accommodate different user capacity requirements. The boiler is self-contained in a free-standing housing which is mounted adjacent to the heated premises. Details to the construction of such boilers can be found in related trade literature of Central Boiler, Inc.

Heated boiler liquids are conducted from the boiler 46 through supply and return conduits 48, 50 which extend from the boiler 46 underground to the premises. The conduits 48, 50 typically comprise plastic tubing of an appropriate inside diameter which is capable of accommodating the operating pressure and temperature of the system. Coupled to the supply and return conduits 48, 50 are stub conduits 49, 51 which mate with the improved exchanger 44 at the hot water heater 4.

Where the prior art exchanger 2 was externally mounted 10 to the side of the water heater 4, the improved exchanger 44 is internally or submersibly mounted at the ¾ inch port or bunghole 22 in lieu of the sacrificial anode normally secured to the port 22. This anode is commonly not required and may be removed in most settings without appreciable effect on the life of the heater 4. Alternatively, the improved exchanger 44 may include an anode section 52, see also FIG. 3.

The improved exchanger 44 generally includes a submersible outer body or housing 54 which substantially extends the complete height of the water heater 4. A threaded fitting 56 is fitted along the housing 54 and is secured to the bunghole 22. The fitting 56 seals the joint between the exterior surface of the housing 54 and the heater 4. An exposed coupler head 58 projects above the water heater 4 and includes an inlet port 60 and an outlet port 62. The ports 60 and 62 are coaxially mounted and radiate from a longitudinal axis 64 of the exchanger 44, see also FIG. 3.

Although the wood fueled boiler 46 may be operated only during a portion of a typical year, the water heater typically includes a separate alternative fuel, heater element that accommodates off-seasons. For example, the heater 4 may include either an electric element or a gas fired burner. During off-seasons, such as the summer, the user may switch to the alternative energy source without any mechanical change to the water heating system. Alternatively, no user activity may be required, since the alternative heater element can be coupled to respond automatically to sensed changes in the water temperature. On occasion, both heat sources may thus operate simultaneously.

Figure 3:
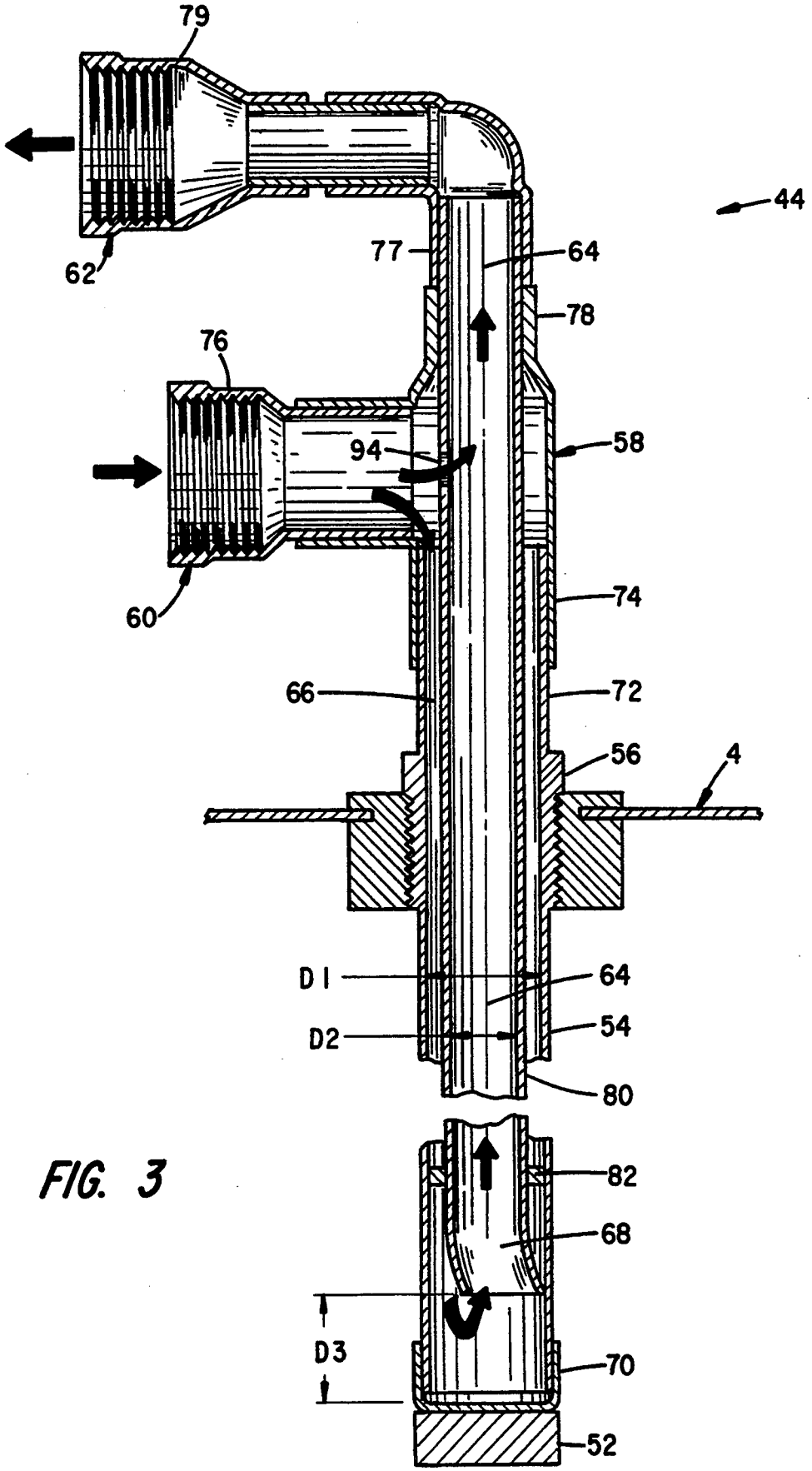
FIG. 3 is a longitudinal cross-section view taken along section lines 3—3 through one heat exchanger of the invention.

With further attention to FIG. 3, the inlet port 60 opens to an interior cavity space or column 66 having a diameter "D1" at the surrounding manifold housing 54 to receive a heated boiler liquid. The liquid is directed through the column 66 to the bottom of the housing 54 where a second column 68 of a reduced inside diameter "D2" extends upward to the outlet port 62. Heat is transferred from the housing 54 to the water of the water heater 8. At typical boiler operating pressures of 5 to 10 psi and a flow rate of 1 to 5 gal/min through the conduits 49, 51, a sufficient volume of heated water is available at the hot water heater 4 to accommodate desired recovery times. The water heater 4 and boiler 46 are typically sized to accommodate the anticipated user demand at the premises.

The exchanger 44 is configured from conventional, commercially available plumbing parts. The manifold housing 54 comprises a length of $\frac{3}{4}$ inch inside diameter copper tubing. The tubing is cut to a length on the order of 36 to 50 inches, which accommodates the height of most conventional water heaters. An end cap 70 seals the lower end of the housing 54. A sacrificial anode 52, if included, is electrically bonded to the end cap 70.

The exposed end 58 of the housing 54 is fitted to a $\frac{3}{4}$ inch threaded fitting 56 which mounts within the anode bunghole 22 that is soldered to the housing 54. A $\frac{3}{4}$ inch stub piece 72 extends from the threaded fitting 56 to a $\frac{3}{4} \times \frac{3}{4} \times \frac{1}{2}$ inch Tee-fitting 74. A $\frac{3}{4}$ inch female coupler 76 projects from the sidewall of the T-fitting 74 to receive the inlet liquid.

The end of the fitting 78 is reduced to provide a bore which accommodates a $\frac{1}{2}$ inch inside diameter tubular conduit 80. A bushing may also be used with a $\frac{3}{4}$ inch fitting. The conduit 80 extends into the flow column 66. The bore of the conduit 80 defines the return flow column 68. The upper end of the conduit 80 mates with an elbow 77 and to which a female coupler 79 is mounted which defines the outlet port 62.

Figure 4:
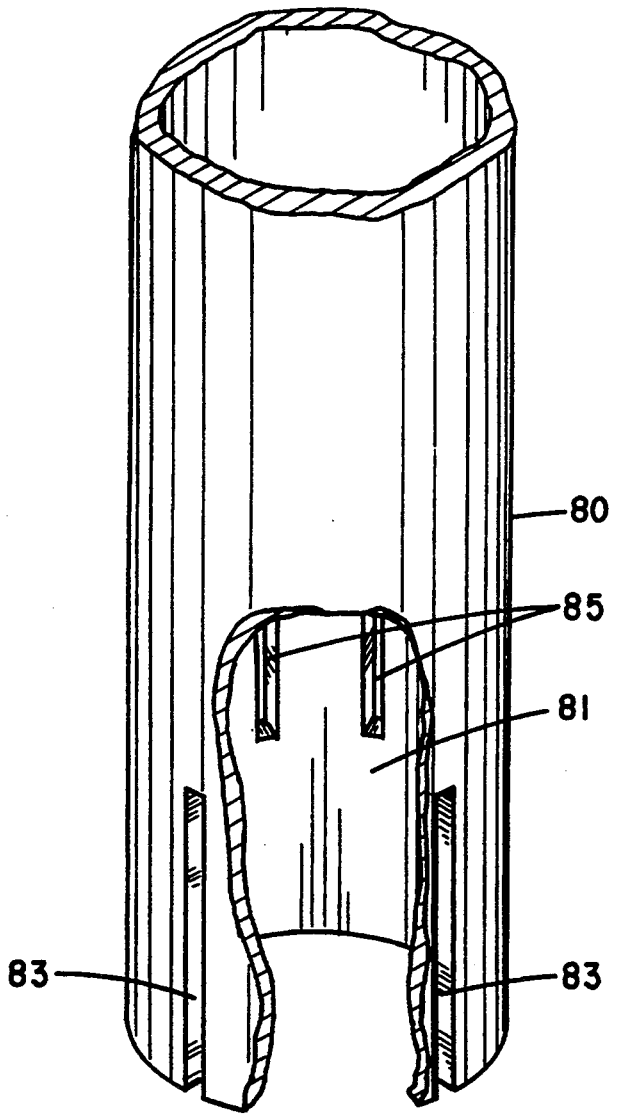
FIG. 4 is a drawing of an inner flow column containing an alternative flow path transition zone.

To facilitate thermal transfer, the conduit 80 extends substantially the full length of the housing 54. The conduit 80 can be shortened as desired. Presently, the conduit 80 is sized to approximately the same length as the tubular manifold housing 54. Due to the dimensional offset of the exposed inlet and outlet ports 60, 62 above the heater 4, which is approximately 6 to 12 inches, a corresponding free space "D3" is provided at the bottom of the housing 54 in which flow is redirected to the inner conduit 80, without creating a hot spot at the end of the housing 54. That is, as the boiler liquid migrates from the larger diameter housing 54 and column 66 to the smaller diameter housing 80 and column 68, flow rates vary and additional heat can be developed. FIG. 4 below discusses an alternate arrangement to merely providing an extended transition region D at the ends of the housings 54 and 80.

FIG. 4 particularly depicts a portion of an inner housing 80 which has been modified to include a number of vertical slots 83. The slots 83 can be formed adjacent to the transition region D3 where the heated liquid migrates from the outer column 66 to the inner column 68. Alternatively, slots 85 can be formed into and along the length of the walls of the housing 80. The slots 83 and 85 facilitate flow through the exchanger 44 and prevent potential blockage from any scale or the like which might form over time. Typically, however, additives are added to the boiler liquid to dissolve any such scale and assure unrestricted flow.

Returning attention to FIG. 3, mounted between the inner surface of the manifold housing 54 and the outer surface of the inner housing 80 is an annular separator or collar 82. The collar 82 is secured near the lower end of the exchanger 44. The collar 82 concentrically supports the tubular housings 54, 80 with respect to each other and prevents possible contact between the inner housing 80 and outer housing 54 and consequent sound transfer through the water supply system. Preferably, the inner housing 80 is also not rigidly mounted to the outer housing to prevent potential stress over time.

FIG. 3 also depicts an alternative arrangement where the end of the housing 80 is bent such that the end of the housing 80 firmly contacts the inner wall of the housing 54. At low operating pressures a firm contact negates vibration and the need for a collar 82.

Figure 5:
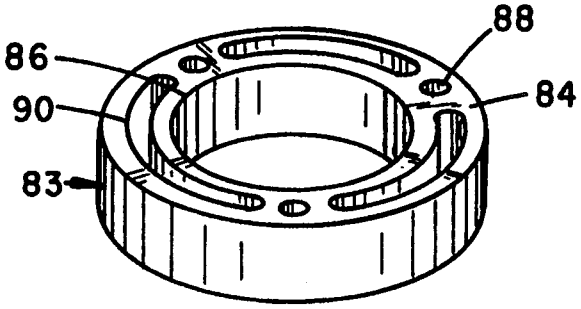
FIG. 5 is a perspective drawing of a portal separator.

For those instances where a collar is used, FIG. 5 depicts a particular construction of a collar 83. The collar 83 provides an annular body 84 having a primary bore 86. The tubular housing 80 mounts inside the primary bore 86. A number of bypass ports, that is, bores 88 and/or slots 90, extend through the body 84 to permit liquid flow to pass through the collar 82. The particular organization of the bypass ports can be varied as desired.

Figure 6:
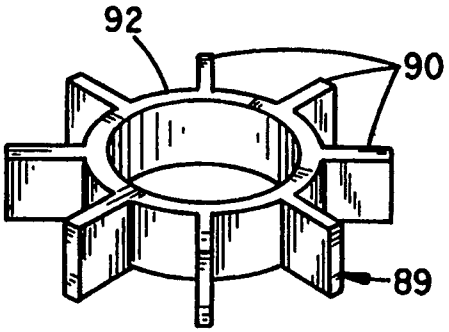
FIG. 6 is a perspective drawing of a finned separator.

In lieu of a collar 83, FIG. 6 shows a finned collar 89 which includes a number of radial fins or projections 90 that radiate from an annular body piece 92. The collar 89, like the collar 83, is made from a material compatible with the environment and has sound deadening properties. A variety of plastics meet these requirements.

Returning attention to FIG. 3, the flow characteristics of a system can be varied to effect the thermal transfer to the water in the tank 8. One way is to include one or more bypass ports 94 through the walls of the housing 80 to permit flow between the inner and outer flow columns 66, 68, without the flow having to traverse the complete length of the heat transfer column 66. A single bypass port 94 of a nominal $\frac{1}{8}$ inch diameter positioned as shown at the inlet port 60 has been found to substantially reduce the flow rate through the exchanger 44. Depending on the system, the number, size and positioning of bypass ports 94 can be varied along the length of the inner housing 80 to vary the BTU transfer.

Figure 7:
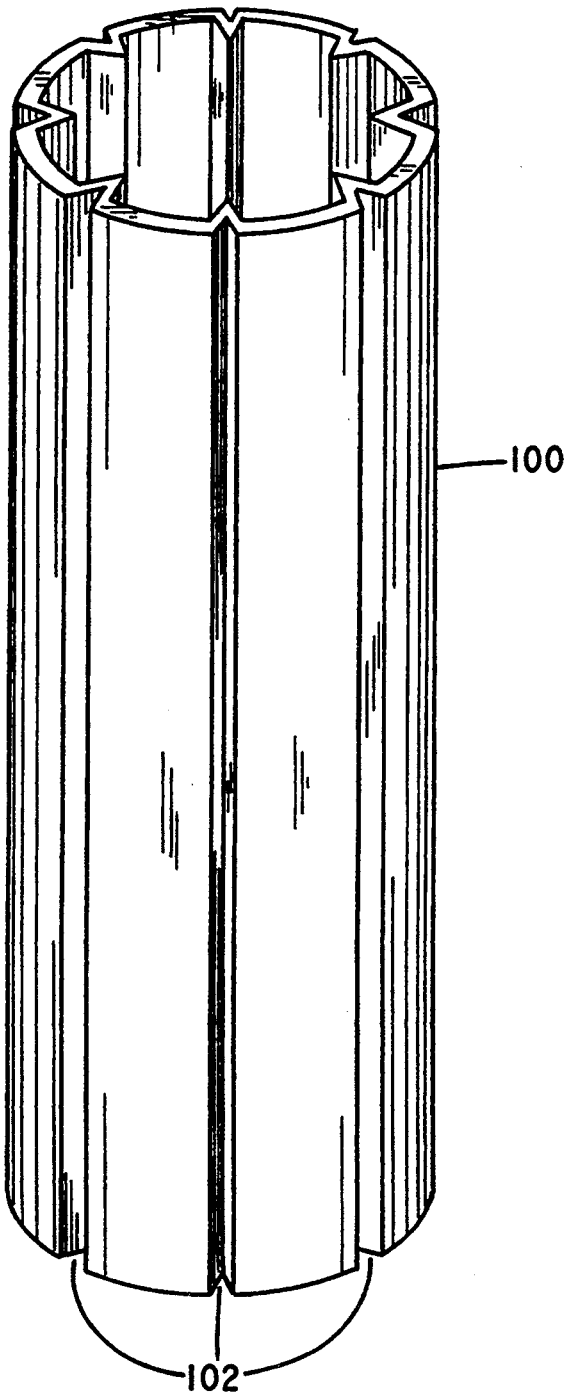
FIG. 7 is drawing of a convoluted manifold housing.

Thermal transfer from the housing 54 to the heated water can also be varied by increasing the surface area of the manifold housing 54. FIG. 7 depicts a portion of a manifold housing 100 which includes a number of longitudinal striations or depressions 102 that are formed into the housing walls. The depressions 102 are particularly formed by scoring the housing wall with a wheeled roller. Alternatively, the walls may be dimpled or formed to include a variety of differently shaped protrusions and depressions. The housing 100 may also be cast or formed, such as by extrusion, to provide a variety of other convoluted surface shapes to increase the exposure area.

Figure 8:
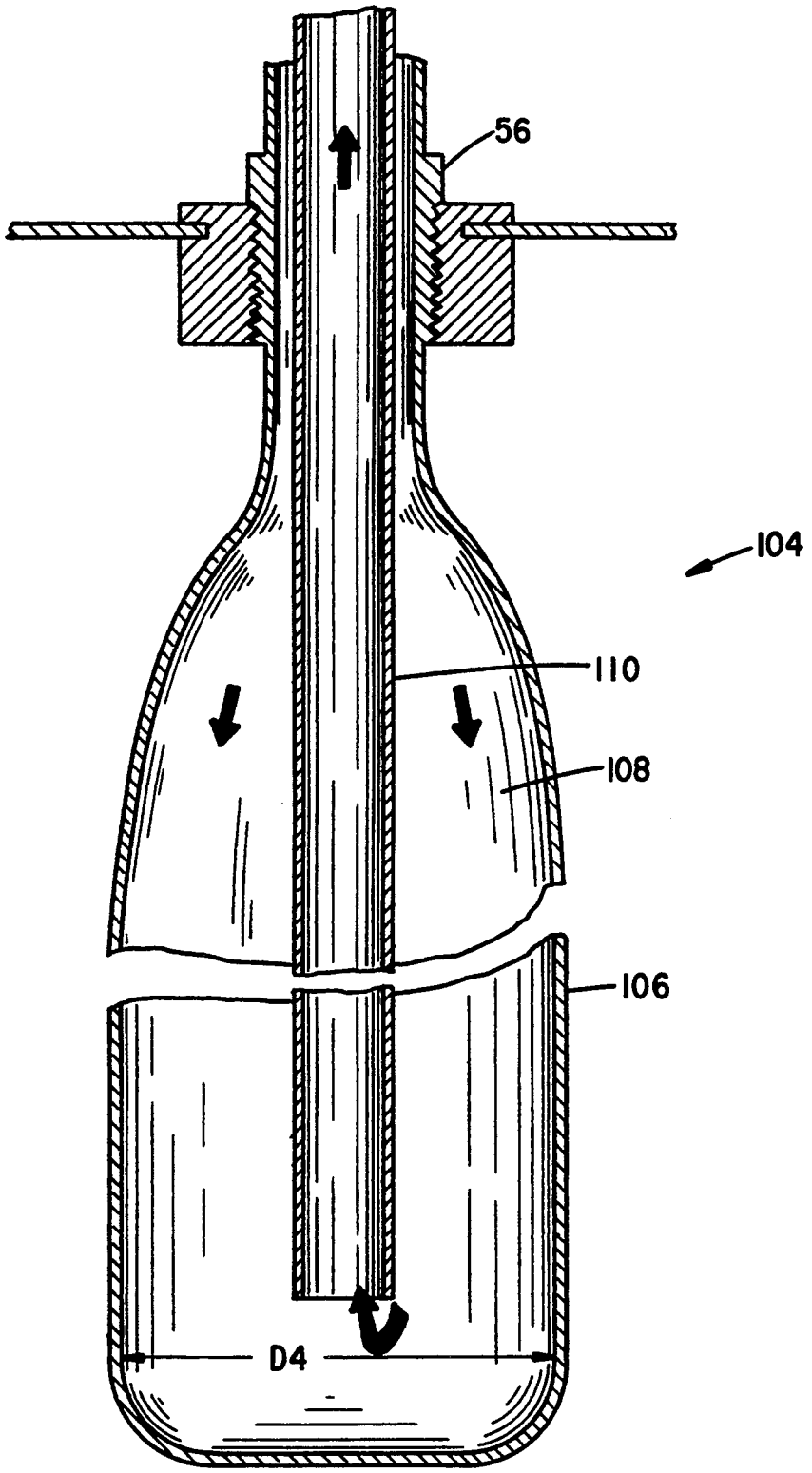
FIG. 8 is a drawing of an exchanger which includes an expandable housing.

FIG. 8 depicts still another exchanger construction 104. The manifold housing 106 provides a diameter D4 which is substantially greater than the diameter of the port 22. The increased diameter is achieved by constructing the manifold housing 106 from an expandable material. When contracted, the material permits insertion of the exchanger 104 through the $\frac{3}{4}$ inch port 22. When the flow column 108 is filled with liquid, the walls expand to a diameter greater than the port 22.

Preferably, the housing 106 is constructed of an expandable thin walled material. For example, a thin wall stainless steel, copper or various thermoplastic materials can be used. Such materials are flexible enough to permit the material to compress about an inner housing 110, during the fitting of the exchanger 104 to the water heater 4, yet expand at normal operating flow pressures to increase the thermal transfer area.

Depending upon the housing material, conventional coupling techniques are used to couple the housing 106 to the threaded fitting 56. For example, silver soldering or compression fittings with or without a suitable sleeve to mate with the threaded fitting 56.

Although the invention has been described with respect to a presently preferred construction and considered modifications and improvements thereto, it is to be appreciated still other constructions may be suggested to those skilled in the art. The invention should therefore not be interpreted in limitation to the disclosed constructions. Rather, the invention should be interpreted in view of the spirit and scope of the following claims.

What is claimed is:

1. Liquid-to-liquid heat exchange apparatus comprising:

(a) a first housing having a first cavity which extends along a longitudinal axis to a closed end;

(b) means secured to said first housing for supporting said first housing to a liquid storage tank and submersing said first housing in a first liquid contained in said storage tank;

(c) a second housing having a longitudinal bore which bore terminates at an open end and an aperture which extends through a sidewall and communicates with said first cavity and bore;

(d) means for supporting said second housing within said first cavity such that the open end is displaced adjacent to said closed end; and (e) means exposed at said storage tank having a first port communicating with said first cavity and a second port communicating with the bore for coupling a second liquid through said first cavity and bore and said first and second ports and wherein a portion of the flow of said second liquid bypasses said open end.

2. Apparatus as set forth in claim 1 wherein said second housing concentrically extends along said longitudinal axis within said first housing and said first and second ports project transverse to said longitudinal axis.

3. Apparatus as set forth in claim 1 wherein said second housing includes a plurality of apertures displaced along the length of the second housing and wherein ones of said apertures occur adjacent the open end.

4. Apparatus as set forth in claim 3 wherein ones of said apertures comprise longitudinal slots.

5. Apparatus as set forth in claim 1 wherein the submersible portion of said first housing includes a plurality of convoluted wall surfaces.

6. Apparatus as set forth in claim 5 wherein said convoluted wall surfaces comprise a plurality of longitudinal depressions.

7. Apparatus as set forth in claim 5 wherein said convoluted wall surfaces comprise a plurality of dimpled depressions.

8. Apparatus as set forth in claim 1 wherein the first housing comprises a cylindrical pipe having a threaded fastener secured to an external surface, which fastener mates with a port of a water heater having a supplemental heating element, and further comprises first and second couplers which project from said first housing external to the water heater and mate with conduits containing said second liquid.

9. Apparatus as set forth in claim 1 wherein the portion of said first housing submersed in the storage tank is expandable, whereby the walls expand with the admission of said second liquid to said first cavity.

10. Apparatus as set forth in claim 1 including separation means for spacing said second housing apart from said first housing without interrupting liquid flow through said first cavity.

11. Apparatus as set forth in claim 10 wherein the separation means comprises a body which mounts to said second housing and includes a plurality of longitudinal bores.

12. Apparatus as set forth in claim 10 wherein said separation means comprises a body which mounts to said second housing and includes a plurality of fins which radiate from said body.

13. Apparatus as set forth in claim 1 including a sacrificial anode means coupled to said first housing.

14. Liquid-to-liquid heat exchange apparatus comprising:

(a) a first tubular housing having a first bore which extends along a longitudinal axis to a closed end;

(b) a threaded fastener secured to an external surface of said first housing for retaining the apparatus to a water heater and submersing said first housing in a first liquid contained in said water heater;

(c) a second tubular housing having a longitudinal second bore, which bore terminates at an open end;

(d) means for supporting said second housing to concentrically extend within said first bore such that the open end is displaced adjacent to said closed end;

(e) means for spacing said second housing apart from said first housing; and (f) means having a first port communicating with the first bore and a second port communicating with the second bore, wherein said first and second ports are coaxially aligned along said longitudinal axis, for directing a second liquid through said first and second bores and said first and second ports.

15. Apparatus as set forth in claim 14 wherein said second housing includes at least one aperture along the length of the second housing which communicates between said first and second bores.

16. Apparatus as set forth in claim 14 wherein the walls of said first housing which are submersed includes a plurality of convoluted surfaces.

17. Apparatus as set forth in claim 14 including a sacrificial anode means coupled to said first housing.

18. Heat exchange apparatus comprising:

(a) wood fired boiler means for heating a first liquid;

(b) means for coupling said first liquid in a closed loop flow path to liquid-to-liquid heat exchange apparatus at a storage tank containing a second liquid and having means for heating the second liquid from a supplemental heat source, wherein said heat exchange apparatus comprises:

(1) a first tubular housing having a first bore which extends along a longitudinal axis to a closed end, (2) a threaded fastener secured to said first housing and mating with a port of said storage tank to submerse a substantial portion of said first housing within said second liquid, (3) a second tubular housing having a longitudinal second bore, which bore terminates at an open end, (4) means for supporting said second housing to concentrically extend within said first cavity such that the open end is displaced adjacent to said closed end, and (5) means having a first port communicating with said first bore and a second port communicating with the second bore, wherein said first and second ports are coaxially aligned along said longitudinal axis, for directing said second liquid through said first and second cavities and said first and second ports.

* * * * *